US007105996B2

(12) United States Patent
Kim et al.

(10) Patent No.: US 7,105,996 B2
(45) Date of Patent: Sep. 12, 2006

(54) ELECTRON GUN FOR COLOR CRT

(75) Inventors: Moon-Sik Kim, Kyeongsangbuk-do (KR); Hyun-Cheol Kim, Kyeongsangbuk-do (KR); Byung-Kyu Kang, Kyeongsangbuk-do (KR)

(73) Assignee: LG.Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/678,072

(22) Filed: Oct. 6, 2003

(65) Prior Publication Data

US 2004/0080255 A1 Apr. 29, 2004

(30) Foreign Application Priority Data

Oct. 24, 2002 (KR) ..... 10-2002-0065272

(51) Int. Cl.
*H01J 29/46* (2006.01)
*H01J 29/56* (2006.01)
*H01J 29/62* (2006.01)

(52) U.S. Cl. ..... 313/446; 313/414; 313/412; 313/413; 313/416

(58) Field of Classification Search ..... 313/441–460, 313/414

See application file for complete search history.

(56) References Cited

U.S. PATENT DOCUMENTS 4,370,592 A * 1/1983 Hughes et al. ..... 313/414
4,581,560 A 4/1986 Shirai et al.
4,622,491 A 11/1986 Izumida et al.
4,626,738 A * 12/1986 Gerlach ..... 313/414
4,766,344 A * 8/1988 Say ..... 313/414
5,517,078 A * 5/1996 Sugawara et al. ..... 313/412
6,545,403 B1 * 4/2003 Lee ..... 313/414

FOREIGN PATENT DOCUMENTS

GB 002052847 A * 1/1981 ..... 313/442
JP 07-142003 6/1995

* cited by examiner

*Primary Examiner*—Marceli Santiago
*Assistant Examiner*—Elizabeth Rielley
(74) *Attorney, Agent, or Firm*—McKenna Long & Aldridge LLP

(57) ABSTRACT

An electron gun for a color CRT includes a main focusing lens unit that focuses the electron beams generated by a triode unit. The main focusing lens unit includes a first and a second electrostatic screen grid having three electron beam through holes linearly-arranged for passing three electron beams, two of the holes being external and an oval shaped hole that passes all three electron beams. The oval shaped holes being spaced a distance, d1 and d2, respectively, from the through holes. Furthermore, the first grid external holes have an external distance HL1 and an internal distance HR1 and the second grid external holes have an external distance HL2 and an internal distance HR2; and wherein HL1 is greater than HR1, HL2 is greater than HR2, d1 is greater than d2, HL2 is greater than HL1, and HL2+HR2 is greater than HL1+HR1.

17 Claims, 7 Drawing Sheets

(A)

[HR1/HR2=1.0]
[HL2/HL1=1.03]

(B)

[HR1/HR2=0.90]
[HL2/HL1=1.03]

(C)

[HR1/HR2=0.80]
[HL2/HL1=1.03]

ELECTRON GUN FOR COLOR CRT

This application claims the benefit of Korean Patent Application No. 2002-65272 filed on Oct. 24, 2002, which is hereby incorporated by reference for all purposes as if fully set forth herein.

BACKGROUND OF THE INVENTION

1. Field of the Invention

The present invention relates to a color CRT, and in particular to an electron gun for a color CRT.

2. Description of the Prior Art

In general, a color CRT is a display used for a television, an oscilloscope, an observation radar, etc., and it displays an image on the front surface of a panel by controlling an electron beam from an electron gun according to a received image signal and by hitting a phosphor formed at the rear of the panel.

FIG. 1 is a schematic view illustrating a general CRT. The CRT includes a panel 102 as a front glass; a funnel 103 as a rear glass forming a vacuum space by being combined with the panel; a phosphor screen coated with a phosphor on the internal surface of the panel 102 for emitting light when struck by an electron beam; an electron gun 106 for emitting an electron beam 107 striking the phosphor screen 104; a deflection yoke 121 installed at a position separated a certain interval from the outer circumference of the funnel 103 in order to deflect the electron beam 107 toward the phosphor screen 104; a shadow mask 105 installed with a certain distance from the phosphor screen 104; a mask frame 109 for fixing/supporting the shadow mask 105; and an inner shield 110 installed a long toward the funnel 103 in order to prevent color purity deterioration by shielding external terrestrial magnetic fields.

As depicted in FIG. 2, the electron gun 106 includes a triode unit consisting of a cathode 130 arranged in a line and generating the electron beam 107 by heating an internal heater, a control grid 131 and an acceleration grid 132 for controlling and accelerating electrons from the cathode 130; and a main focusing lens unit consisting of a focusing grid 133 and an anode 135 for focusing and accelerating the electron beam generated from the triode unit.

The acceleration grid 132 may include a first acceleration grid 132*a* and a second acceleration grid 132*b* installed a certain distance from the control grid 131 and installed a certain distance from the cathode 130 towards the anode 135.

In general, the focusing grid 133 may include two to four grids, as depicted in FIG. 2. It includes a first focusing grid 133*a* installed between the first acceleration grid 132*a* and the second acceleration grid 132*b*; and a second focusing grid 133*b* installed with a certain distance from the second acceleration grid 132*b*.

In the above-described electron gun 102, when power is applied, an electron beam is generated from the surface of the cathode 130 by heating of the heater, is controlled by the control grid 131, is accelerated by the first and second acceleration grids 132*a*, 132*b*, and is focused or accelerated by the first and second focusing grids 133*a*, 133*b* and the anode 135. The electron beam focused and accelerated by the focusing grid 133 and the anode 135 is deflected by the deflection yoke 121, and it is emitted to the phosphor screen 104 of the panel 102.

Herein, the control grid 131 is grounded, 500V~1000V is applied to the acceleration grid 132, high voltage as 25 kV~35 kV is applied to the anode 135, and an intermediate voltage as 20~30% of an anode voltage is applied to the focusing grid 133.

In particular, because an electrostatic lens is formed between the second focusing grid 133*b* and the anode 135, the electron beam 107 generated in the triode unit is focused at the center of the phosphor screen 104.

The focusing state of the electron beam 107 can be described by Equation 1:

$$Ds=\sqrt{(Dx+Dsa)^2+(Dsc)^2} \quad \text{(Equation 1)}$$

Where,

Ds: size of the final pixel

Dx: magnification of a main lens

Dsa: spherical aberration

Dsc: enlarged element by space charge repulsive effect

As shown in Equation 1, the size of the final pixel (Ds) on the screen is affected by a spherical aberration (Dsa). The main lens directly related to the spherical aberration (Dsa) is formed between the second focusing grid 133*b* and the anode 135. The corresponding holes 150, 160 are respectively formed at the second focusing grid 133*b* and the anode 135 so as to face each other. The corresponding hole 150 has an oval shaped rim structure, and the red, green, blue electron beams pass through the hole 150 at the same time.

An electrostatic screen grid 134 is formed at the corresponding holes 150, 160 as an inner grid. An inner grid formed in the second focusing grid 133*b* is called a first electrostatic screen grid 134*a*, and an inner grid formed in the anode 135 is called a second electrostatic screen grid 134*b*. The first and second electrostatic screen grids 134*a*, 134*b* are formed in order to have uniformity of the three (R, G, B) electron beams, and they make the three electron beams have the same shape.

As depicted in FIG. 3, in the first and second electrostatic screen grid 134*a*, 134*b*, three electron beam through holes 140 arranged in a line are formed so as to pass three electron beams, and the three electron beams through holes 140 and the corresponding holes 150, 160 form the main focusing lens.

In a conventional electron gun 106, the first and second electrostatic screen grids 134*a*, 134*b* have the same shape and size, the distance (Lb1) between the first electrostatic screen grid 134*a* and the corresponding hole 150 is same as the distance (Lb2) between the second electrostatic screen grid 134*b* and the corresponding hole 160.

In addition, as depicted in FIG. 4, the three electron beam through holes 140 formed at the first and second electrostatic screen grids 134*a*, 134*b* consist of two external holes 140*a* and one central hole 140*b*. Herein, the external hole 140*a* has a vertical size (WO) greater than a horizontal size (HLO+HRO), and generally it has a shape that is longer in the vertical direction. FIG. 4 shows the shape of the electron beam through hole of the conventional electrostatic screen grid 134. The center of the hole is the central point of a vertical line traversing the largest vertical extent of external hole 140*a*. In the horizontal direction, the distance from the center of the external hole 140*a* to the left and right sides of the central hole 140*b* are the distances HLO and HRO respectively. The horizontal size of the external hole 140*a* can be described as HRO+HLO.

In the conventional electron gun, HRO of the external hole 140*a* is 2.53 mm, and HLO is 2.90 mm resulting in a horizontal size of 5.43 mm. The vertical size of the external hole 140*a* is 5.96 mm, and accordingly it has a vertically long shape.

The electron beam convergence is defined as the distance between the red (R) electron beam and the blue (B) electron beam among three electron beams on the screen. As depicted in FIG. 4, in the conventional electron gun 106, the distances between the external hole 140*a* and the central hole 140*b* is generally 5.5 mm. The distance between the red (R) electron beam and the blue (B) electron beam is 2×S, and the electron beam convergence is about 11 mm in the conventional electron gun.

In the first and second electrostatic screen grids 134*a*, 134*b*, the red electron beam is separated from the blue electron beam by 11 mm, and the distance is about 8–10 mm on the screen. However, it has to be "0" on the screen in order to prevent pixel distortion. Generally, only when the electron beam convergence (OCV) is within 2 mm on the screen, is it possible to adjust. Accordingly, in the conventional art, in order to solve this problem, a pre-convergence is performed between the first accelerating grid 132*a* and the first focusing grid 133*a*, and accordingly the electron beam 107 passes the grids from the first focusing grid 133*a* to the main lens having a potential difference different from each other. However, when the electron beam 107 passes the control grid 131 and the second focusing grid 133*b*, the electron beam convergence of the first and second electrostatic screen grids 134*a*, 134*b* having almost same shape and size is lowered, and accordingly it exceeds the adjustment range.

SUMMARY OF THE INVENTION

Accordingly, the present invention is directed to an electron gun for a color CRT substantially obviates one or more of the problems due to limitations and disadvantages of the related art.

An advantage of the present invention to provide an electron gun for a color CRT capable of making a uniform electron beam by preventing distortion of a pixel and improving the resolution by attaining an electron beam convergence within 2.0 mm.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings To achieve these and other advantages and in accordance with the purpose of the present invention, as embodied and broadly described, in an color CRT, an electron gun for the color CRT includes a triode unit for generating three electron beams and controlling and accelerating the generated electron beams; a main focusing lens unit that focuses the electron beams generated by the triode unit; a first electrostatic screen grid installed in the main focusing lens unit having three electron beam through holes linearly-arranged for passing the three electron beams and two of the holes are external holes, and the first grid having a first oval shaped hole that passes all three electron beams, the first oval shaped hole spaced a distance d1 from the through holes; and a second electrostatic screen grid installed in the main focusing lens unit having three electron beam through holes linearly-arranged for passing the three electron beams and two of the holes are external holes, and the second grid having a second oval shaped hole that passes all three electron beams, the second oval shaped hole spaced a distance d2 from the through holes; wherein the first grid external holes have an external distance HL1 and an internal distance HR1 and the second grid external holes have an external distance HL2 and an internal distance HR2; and wherein HL1 is greater than HR1, HL2 is greater than HR2, d1 is greater than d2, HL2 is greater than HL1, and HL2+HR2 is greater than HL1+HR1.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
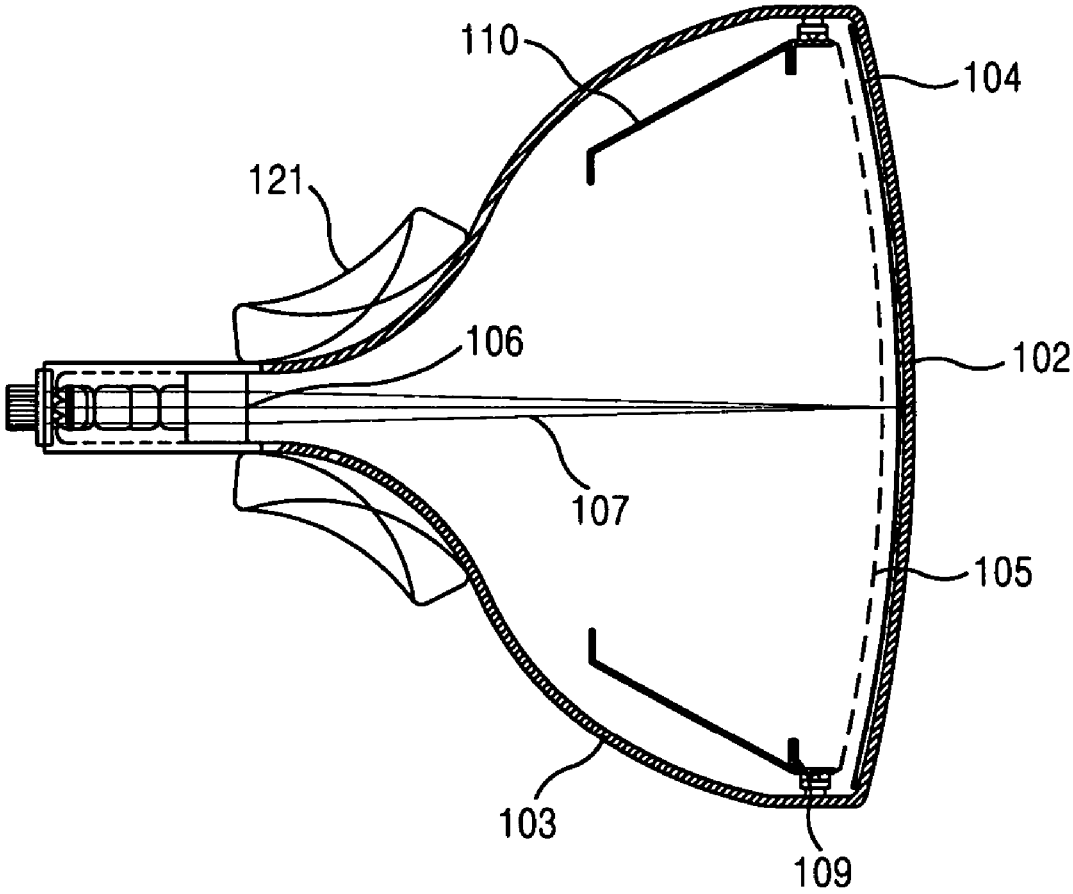
FIG. 1 CONVENTIONAL ART
FIG. 1 is a sectional view illustrating a structure of a general color CRT.
Figure 2:
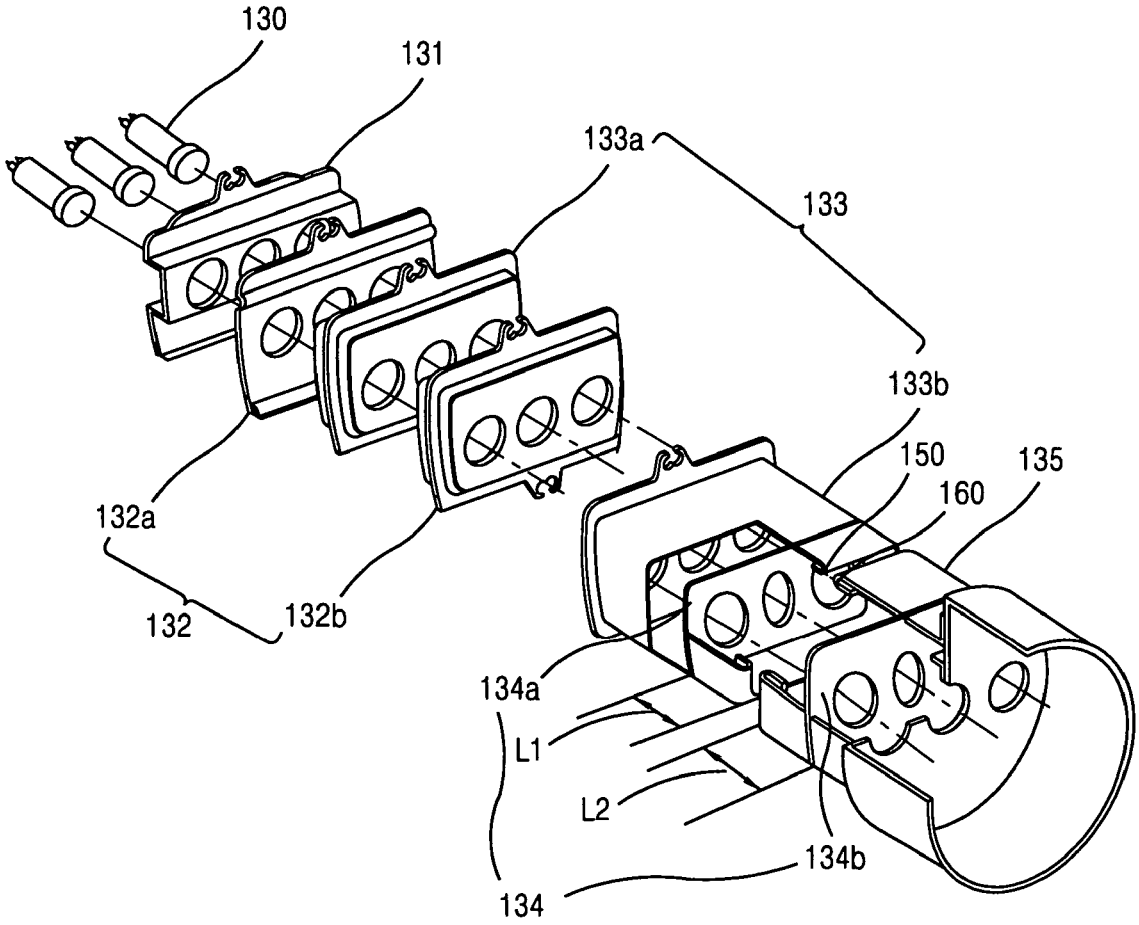
FIG. 2 CONVENTIONAL ART
FIG. 2 is a perspective view illustrating an electron gun for a general color CRT.
Figure 3:
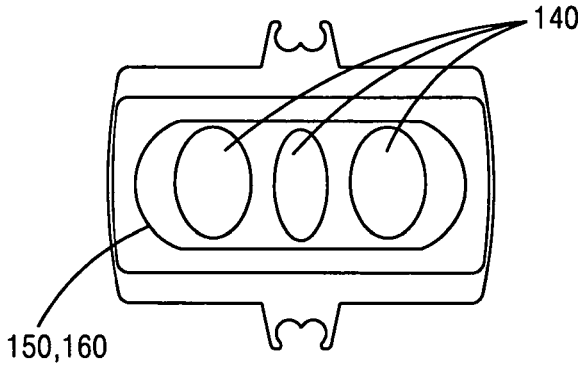
FIG. 3 CONVENTIONAL ART
FIG. 3 is a front view illustrating the conventional first and second electrostatic screen grids.
Figure 4:
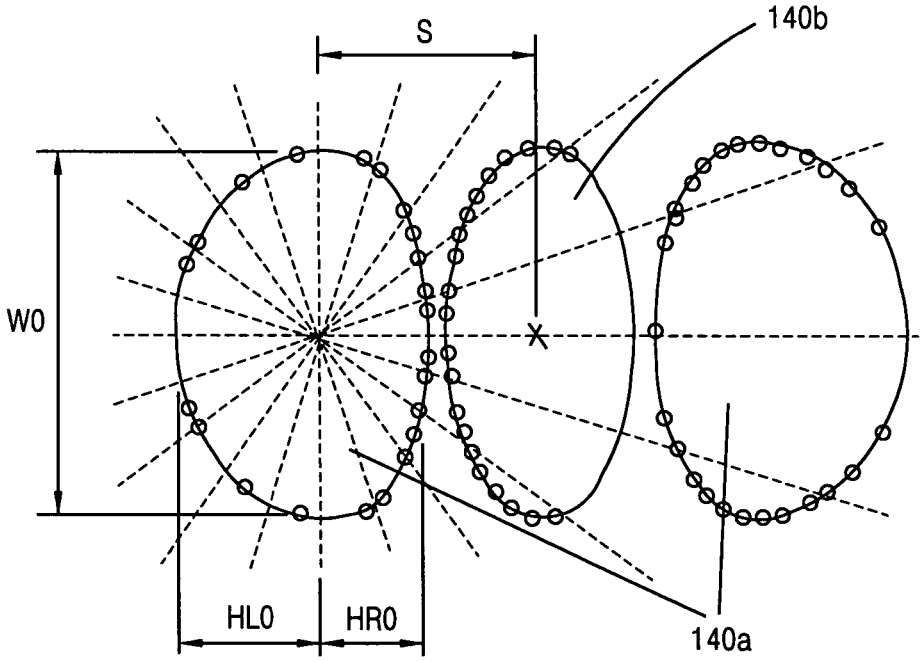
FIG. 4 CONVENTIONAL ART
FIG. 4 is a schematic view illustrating electron beam through holes of the conventional first and second electrostatic screen grids.
Figure 5:
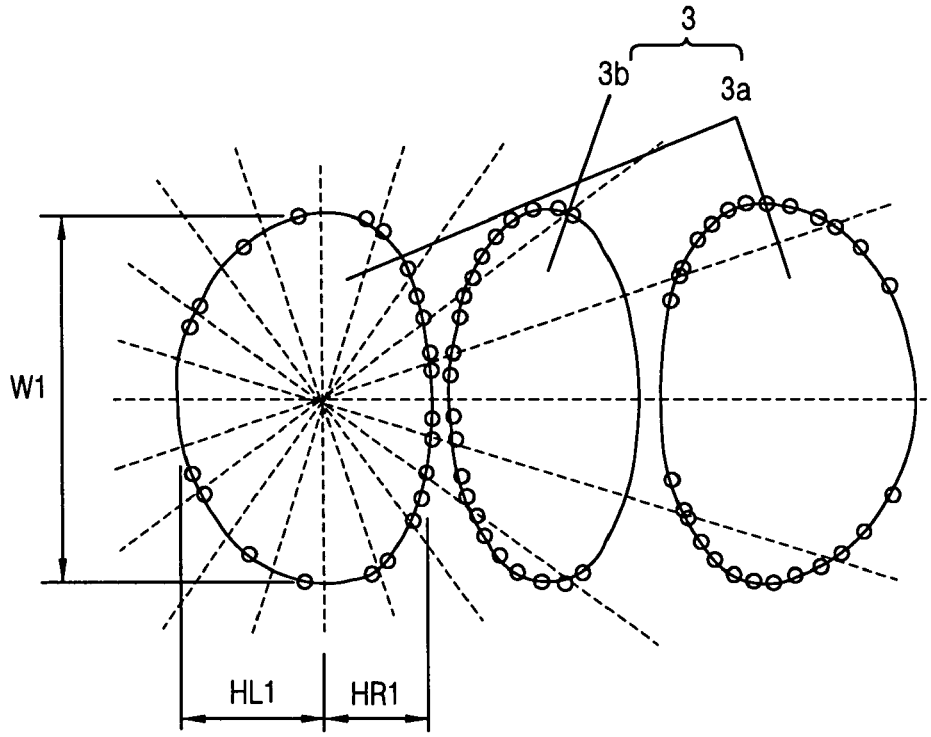
FIG. 5 is a schematic view illustrating an electron beam through hole of a first electrostatic screen grid in accordance with the present invention.
Figure 6:
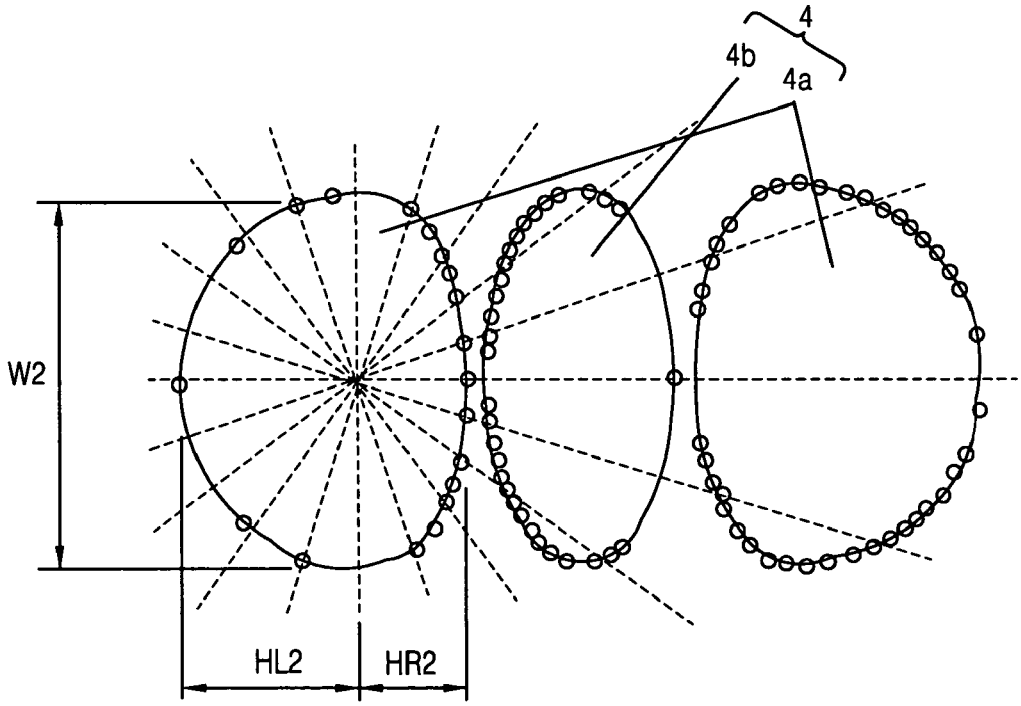
FIG. 6 is a schematic view illustrating an electron beam through hole of a second electrostatic screen grid in accordance with the present invention.

Reference will now be made in detail to an embodiment of the present invention, example of which is illustrated in the accompanying drawings.

As depicted in FIGS. 5 to 9, an electron gun for a color CRT in accordance with the present invention includes a triode unit for generating three electron beams, controlling and accelerating electron beams, and a main lens unit for focusing and accelerating the electron beams controlled and accelerated in the triode unit.

The main lens unit includes: a first focusing grid 133*a* installed among the plurality of accelerating grids 132 of the triode unit; a second focusing grid 5 installed a certain distance from the accelerating grid 132; and an anode 6 installed a certain distance from the second focusing grid 5.

The second focusing grid 5 and the anode 6 respectively include a first electrostatic screen grid 2*a* having a line-arranged electron beam through holes 3 for passing three electron beams; and a second electrostatic screen grid 2*b* having a line-arranged electron beam through holes 4 for passing the three electron beams. The electron beam through holes 3, 4 respectively formed at the first and second electrostatic screen grids 2*a*, 2*b* consist of the central holes 3*b*, 4*b* which are holes at the center of the three holes; and a pair of external holes 3*a*, 4*a* to the outside of the central hole 3*b*, 4*b*.

The center of the hole is the central point of the vertical line having the largest vertical extent within the external holes 3*a*, 4*a*. In the horizontal direction, a distance from the center of the external holes 3*a*, 4*a* to the side of the external holes toward the central hole 3*b*, 4*b* is an internal distance HR1, HR2; a distance from the center of the external holes 3*a*, 4*a* to the side of the central hole 3*b*, 4*b* away from the central hole is an external distance HL1, HL2. The ratio HL1/HR1 of the external distance HL1 to the internal distance HR1 of the first electrostatic screen grid 2*a* is different from the ratio HL2/HR2 of the second electrostatic screen grid 2*b*.

In the electron gun of the present invention, the improvement of the electron beam convergence through holes 3, 4, of the first and second electrostatic screen grids 2*b* will be shown by test results.

Figure 7:
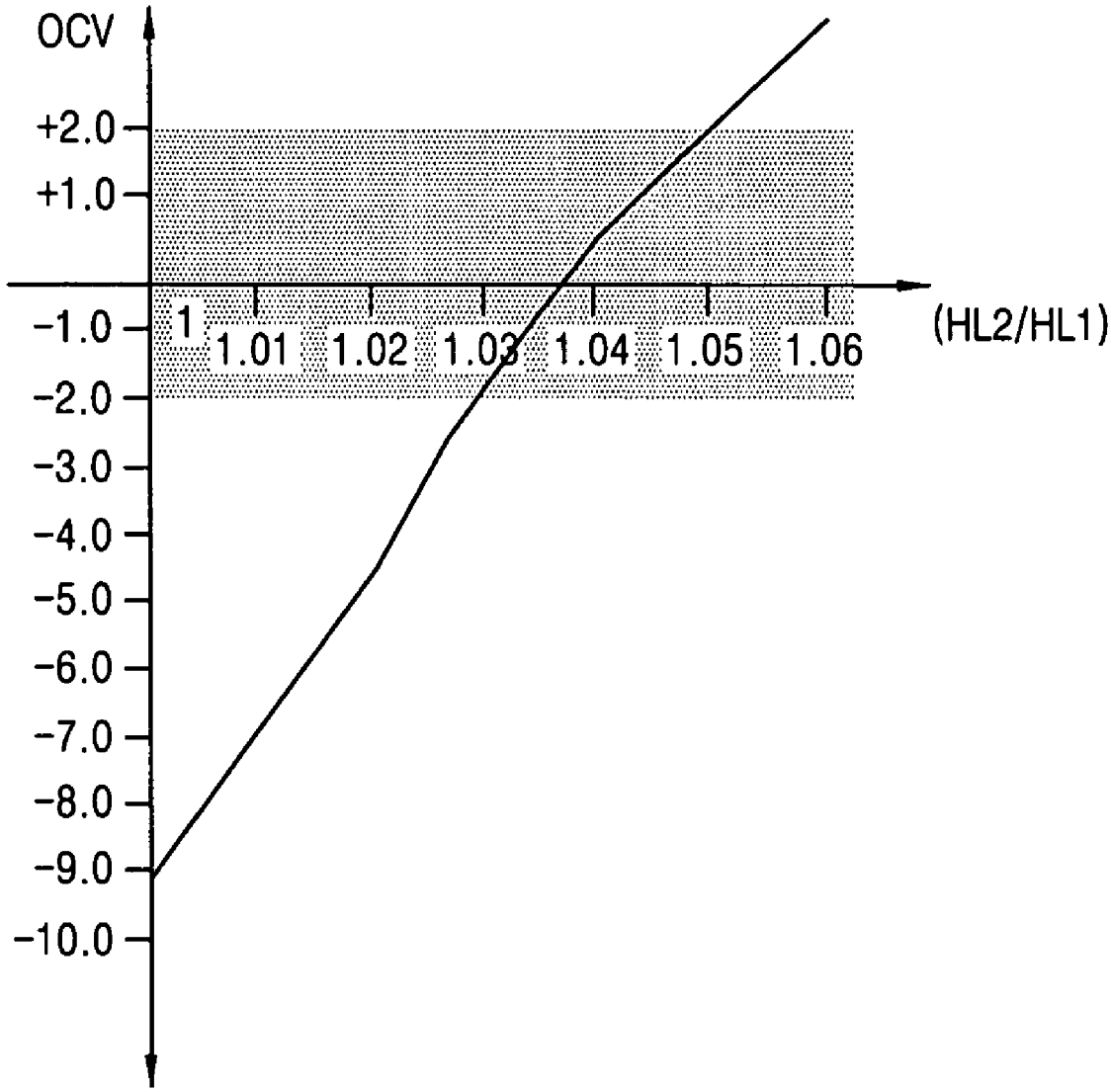
FIG. 7 is a graph showing an electron beam convergence according to the ratio of an internal distance and the external distance of an electron beam through hole.

When HR1 is same as HR2, HL1 and HL2 may be adjusted. FIG. 7 is a plot of HL2/HL1 versus OCV, and if HL2/HL1 is greater than approximately 1.03, the electron beam convergence is not greater than 2 mm. Further, HL1 has to be less than HL2 for HL2/HL1 to be greater than approximately 1.03. Because HL1 and HL2 are important factors for reducing the electron beam convergence (OCV), the smaller H1 is and the greater the HL2 is, the more the electron beam convergence will increase. Accordingly, when the internal distances HR1, HR2 of the first and second electrostatic screen grids 2*a*, 2*b* are equal, HL2/HR2 for the second electrostatic screen grid 2*b* has to be greater than HL1/HR1 ratio of the first electrostatic screen grid 2*a*.

Figure 8:
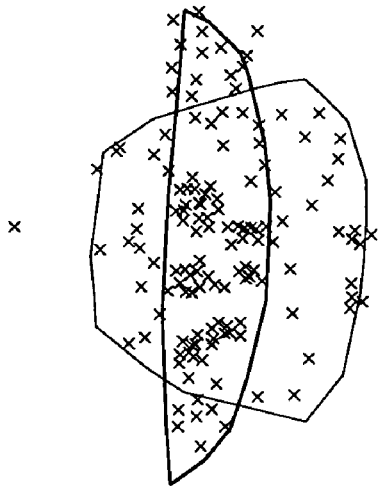
FIG. 8 is a schematic view illustrating the shapes of electron beams according to the ratio of the electron beam through hole internal distance of the first and second electrostatic screen grids.
Figure 8:
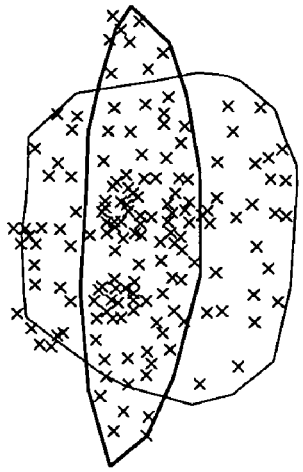
Figure 8:
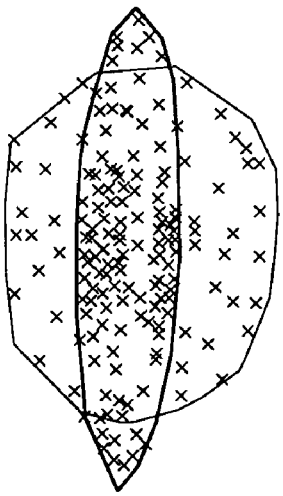

When the electron beam reaches the effective screen, as depicted in FIG. 8, haze occurs in the horizontal direction, a certain core occurs in the vertical direction, and accordingly astigmatism is formed. Herein, the astigmatism occurs by sizes, and resolution is varied according to the shape of astigmatism.

When HL2/HL1 is uniformly determined as 1.03 in order to have an electron beam convergence of 2 mm, and HR1/HR2 is 1.0, as depicted in (A) of FIG. 8, haze occurs in the horizontal direction, and a halfmoon-shaped core occurs in the vertical direction. The shapes of haze and core are different in the left and right sides centering around the central point, in other words, an external electron beam distortion phenomenon occurs.

In order to solve the above-mentioned problem, in the present invention, a horizontal distance HR1+HL1 and is less than a horizontal distance HR2+HL2. At the same time, HR1 is different from HR2.

As depicted in (B) of FIG. 8, when HL2/HL1 is uniformly determined as 1.03 and HR1/HR2 is 0.90, the haze and core is bi-directionally (left and right) asymmetric on the basis of the central axis. However, as depicted in (C) of FIG. 8, when HR1/HR2 is 0.8, the electron beam is bi-directional (left and right) symmetric. When the horizontal distance of the first and second electrostatic screen grids 2*a*, 2*b* is fixed, HL2 is increased according to a decrease of HR2, and bi-directional (left and right) symmetric haze and core may be formed as shown in (C) of FIG. 8.

In the embodiment of the present invention, HL2/HR2 is approximately 2.13, HL1/HR1 is approximately 1.49, and a horizontal distance ratio of the external hole is 1.05 of a horizontal distance of the second electrostatic screen grid 2*b* over the first electrostatic screen grid 2*a*.

Figure 9:
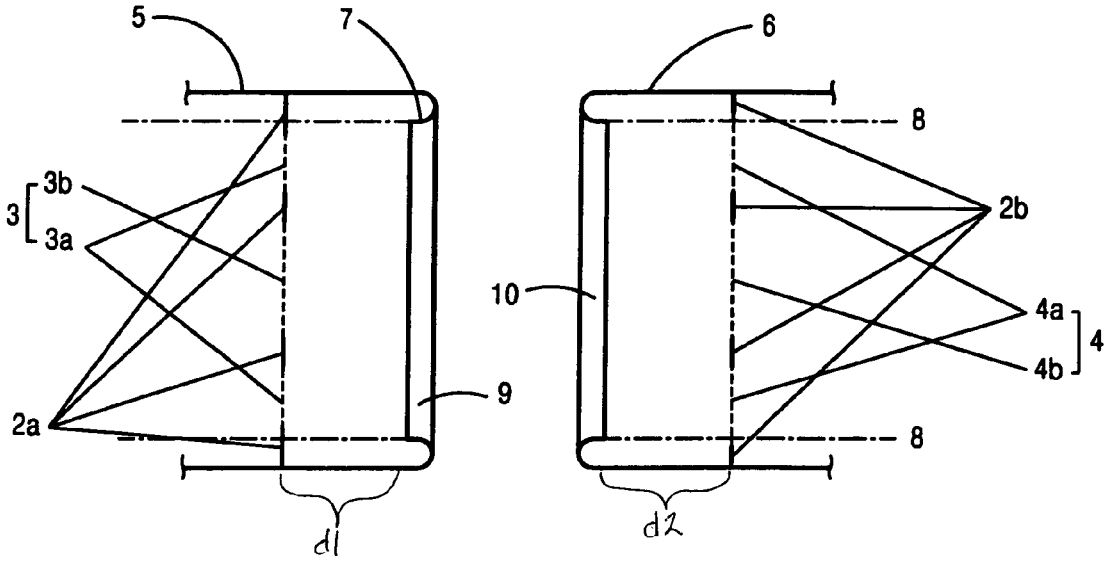
FIG. 9 is a horizontal-sectional view illustrating an external hole of the first and second electrostatic screen grids in accordance with the present invention.

In the electron gun for the color CRT in accordance with the present invention, as depicted in FIG. 9, because the second electrostatic screen grid 2*b* is formed between the second focusing grid 5 and the anode 6, the external holes 3*a*, 4*a* of the first and second electrostatic screen grids 2*a*, 2*b* are formed toward the external side of an axial directional-extended line 8 of a rim unit 7, a horizontal distance of the electron beam through holes 4 is longer than a horizontal distance of the corresponding holes 9, 10. A distance d1 is the distance between the holes 3 and the oval shaped hole 9. A distance d2 is the distance between the holes 4 and the oval shaped hole 10. The distance d1 may be greater than d2. In addition, the length of oval shaped hole 10 may be greater than the length of the oval shaped hole 9.

In addition, a magnetic field may be applied to the electron beams between the triode and the main lens. This may further help to focus the electron beams down to a small size on the phosphorus screen.

In addition, by forming the external electron beam through hole 4*a* of the second electrostatic screen grid 2*b* by using a jig in an electron gun assembly, the assembly can be performed more smoothly.

Figure 10:
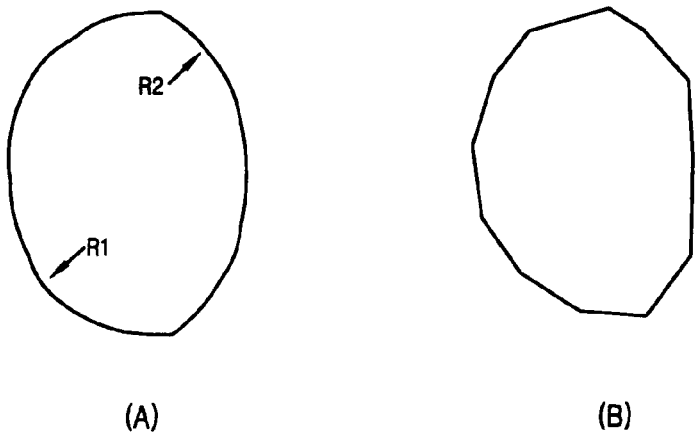
FIG. 10 is a schematic view illustrating other embodiments of an external hole of the present invention.

In the meantime, in the embodiment of the present invention, the external holes of the first and second electrostatic screen grids 2*a*, 2*b* have different oval shapes. However, as depicted in (A) of FIG. 10, it is possible to construct a combination of a plurality of circular arcs (R1, R2) having different radius curvature. In addition, as depicted in (B) of FIG. 10, it is possible to construct a combination of a plurality of straight lines.

In the electron gun in accordance with the present invention, by making uniform electron beams and obtaining an electron beam convergence within 2.0 mm by the optimum-design of the size of the external hole of electron beam through holes, resolution can be improved. Further, by making the haze and core have a symmetric shape, pixel distortion may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electron gun for a color CRT, comprising:

a triode unit for generating three electron beams and controlling and accelerating the generated electron beams;

a main focusing lens unit that focuses the electron beams generated by the triode unit;

a first electrostatic screen grid installed in the main focusing lens unit having three electron beam through holes linearly-arranged for passing the three electron beams and two of the holes are external holes, and the first grid having a first oval shaped hole that passes all three electron beams, the first oval shaped hole spaced a distance d1 from the through holes; and a second electrostatic screen grid installed in the main focusing lens unit having three electron beam through holes linearly-arranged for passing the three electron beams and two of the holes are external holes, and the second grid having a second oval shaped hole that passes all three electron beams, the second oval shaped hole spaced a distance d2 from the through holes;

wherein the first grid external holes have an external distance HL1 and an internal distance HR1 and the second grid external holes have an external distance HL2 and an internal distance HR2; and wherein HL1 is greater than HR1, HL2 is greater than HR2, d1 is greater than d2, HL2 is greater than HL1, and HL2+HR2 is greater than HL1+HR1.

2. A color cathode ray tube comprising:

a front glass panel;

a funnel coupled to the panel;

a fluorescent screen formed on an inside surface of the panel;

a shadow mask with a color selection function, the shadow mask being disposed at a predetermined distance from the fluorescent screen; and an electron gun for a color CRT, further comprising:

a triode unit for generating three electron beams and controlling and accelerating the generated electron beams;

a main focusing lens unit that focuses the electron beams generated by the triode unit;

a first electrostatic screen grid installed in the main focusing lens unit having three electron beam through holes linearly-arranged for passing the three electron beams and two of the holes are external holes, and the first grid having a first oval shaped hole that passes all three electron beams, the first oval shaped hole spaced a distance d1 from the through holes; and a second electrostatic screen grid installed in the main focusing lens unit having three electron beam through holes linearly-arranged for passing the three electron beams and two of the holes are external holes, and the second grid having a second oval shaped hole that passes all three electron beams, the second oval shaped hole spaced a distance d2 from the through holes;

wherein the first grid external holes have an external distance HL1 and an internal distance HR1 and the second grid external holes have an external distance HL2 and an internal distance HR2; and wherein HL1 is greater than HR1 , HL2 is greater than HR2 , d1 is greater than d2 , HL2 is greater than HL1, and HL2+HR2 is greater than HL1+HR1.

3. The color cathode ray tube of claim 2, wherein the triode unit includes a plurality of cathodes for emitting electron beams, a control grid and an acceleration grid.

4. The color cathode ray tube of claim 2, wherein the main lens unit includes a plurality of focusing grids and an anode for focusing the electron beam onto a screen and forming a main focusing lens.

5. The color cathode ray tube of claim 4, wherein the first electrostatic screen grid is installed in the focusing grid, and the second electrostatic screen grid is installed in the anode.

6. The color cathode ray tube of claim 5, wherein a ratio HL2/HR2 is greater than a ratio HL1 /HR1.

7. The color cathode ray tube of claim 6, wherein the ratio HL2/HR2 is about 2.13, and the ratio HL1/HR1 is about 1.49.

8. The color cathode ray tube of claim 2, wherein a ratio HL2/HR2 is greater than a ratio HL1/HR1.

9. The color cathode ray tube of claim 8, wherein the ratio HL2/HR2 is about 2.13, and the ratio HL1/HR1 is about 1.49.

10. The color cathode ray tube of claim 2, wherein a ratio HL2/HL1 is greater than about 1.03.

11. The color cathode ray tube of claim 10, wherein a ratio HL2/HL1 is less than about 1.05.

12. The color cathode ray tube of claim 2, wherein a ratio HL2/HL1 is greater than about 1.02.

13. The color cathode ray tube of claim 12, wherein a ratio HL2/HL1 is less than about 1.06.

14. The color cathode ray tube of claim 2, further comprising a magnetic field acting on the electron beams between the triode unit and the main focusing lens unit.

15. The color cathode ray tube of claim 2, wherein the length of the second oval shaped hole is greater than the length of the first oval shaped hole.

16. The color cathode ray tube of claim 2, wherein the external holes of the electrostatic screen grids consist of a combination of a plurality of circular arcs having different radii of curvature.

17. The color cathode ray tube of claim 2, wherein the external holes of the electrostatic screen grids consist of a combination of a plurality of straight lines.

* * * * *